US006767374B1

(12) United States Patent
Goberdhan et al.

(10) Patent No.: US 6,767,374 B1
(45) **Date of Patent: *Jul. 27, 2004**

(54) FUEL OIL ADDITIVES AND COMPOSITIONS

(75) Inventors: Dhanesh Gordon Goberdhan, Oxford (GB); Robert Dryden Tack, Abingdon (GB); Kenneth Lewtas, Wantage (GB); Andrew Matthew McAleer, Winchester (GB); Lewis John Fetters, Annandale, NJ (US); John Huang, Annandale, NJ (US)

(73) Assignee: Exxon Chemical Patents Inc., Linden, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/913,208

(22) PCT Filed: Mar. 13, 1996

(86) PCT No.: PCT/EP96/01105

§ 371 (c)(1),
(2), (4) Date: Dec. 31, 1997

(87) PCT Pub. No.: WO96/28523

PCT Pub. Date: Sep. 19, 1996

(30) Foreign Application Priority Data

Mar. 14, 1995 (GB) ..... 9505103

(51) Int. Cl.[7] ..... C10L 1/16

(52) U.S. Cl. ..... 44/459; 44/389; 44/393; 44/412; 44/425; 44/443

(58) Field of Search ..... 44/459

(56) References Cited

U.S. PATENT DOCUMENTS

| | | | | | |
|---|---|---|---|---|---|
| 3,600,311 | A | | 8/1971 | Naiman et al. | 44/459 |
| 3,773,478 | A | * | 11/1973 | Feldman | 44/459 |
| 3,961,916 | A | | 6/1976 | Ilnyckyj et al. | 44/395 |
| 4,015,952 | A | * | 4/1977 | Durand et al. | 44/459 |
| 4,019,878 | A | * | 4/1977 | Wisotsky | 44/459 |
| 4,021,207 | A | * | 5/1977 | Durand et al. | 44/459 |
| 4,175,926 | A | * | 11/1979 | Wisotsky | 44/459 |
| 4,211,534 | A | * | 7/1980 | Feldman | 44/394 |
| 4,261,703 | A | * | 4/1981 | Tack et al. | 44/369 |
| 4,367,074 | A | | 1/1983 | Maldonado et al. | 44/62 |
| 5,310,490 | A | * | 5/1994 | Struglinski et al. | 508/591 |
| 5,310,814 | A | * | 5/1994 | Struglinski et al. | 525/314 |
| 5,525,128 | A | * | 6/1996 | McAleer et al. | 44/459 |

FOREIGN PATENT DOCUMENTS

| | | |
|---|---|---|
| EP | A-117108 | 8/1984 |
| EP | A-0 326356 | 8/1989 |
| GB | 1490563 | 11/1977 |
| GB | 2087425 | 5/1982 |
| WO | WO 92/16567 | 10/1992 |
| WO | WO 92/16568 | 10/1992 |
| WO | WO 93/08243 | 4/1993 |

* cited by examiner

*Primary Examiner*—Ellen M. McAvoy

(57) ABSTRACT

Hydrogenated block copolymers are used as a component in a cold flow additive composition.

14 Claims, No Drawings

FUEL OIL ADDITIVES AND COMPOSITIONS

This invention relates to oil compositions, primarily to fuel oil compositions, and more especially to fuel oil compositions susceptible to wax formation at low temperatures, to additives for use in such fuel oil compositions, and to the use of the additives to improve the cold flow properties of fuels.

Fuel oils, whether derived from petroleum or from vegetable sources, contain components, e.g., alkanes, that at low temperature tend to precipitate as large crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognized in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets; certain additives inhibit this and cause the wax to adopt an acicular habit, the resulting needles being more likely to pass through a filter, or forms a porous cake, than are platelets. The additives may also have the effect of retaining in suspension in the fuel the crystals that have formed, the resulting reduced settling also assisting in prevention of blockages.

Effective wax crystal modification (as measured by cold filter plugging point (CFPP) and other operability tests as well as simulated and field performance) may be achieved by flow improvers, for example, by ethylene vinyl acetate (EVAC) or propionate copolymers.

In a first aspect the present invention provides the use, to improve cold flow characteristics of a fuel oil, of an additive composition comprising an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations.

More especially, the invention provides the use, to improve cold flow characteristics of a fuel oil, of an additive composition additionally comprising a cold flow improver other than the hydrogenerated block polymer defined above.

Preferably, the other cold flow improver is selected from (A) ethylene-unsaturated ester compounds, (B) comb polymers, (C) polar nitrogen compounds, (D) compounds comprising a ring system having at least two substituents comprising a linear or branched aliphatic hydrocarbylene group optionally interrupted by one or more hetero atoms and carrying a secondary amino group, the substituents on the amino groups each being a hydrocarbyl group containing 9 to 40 carbons, (E) hydrocarbon polymers, and (F) polyoxyalkylene compounds, the components A to F being other than the hydrogenerated block polymer. The presence of one or more of these other cold flow improvers leads to unexpected enhancements of wax crystal modification additional to those obtained with the block polymer alone.

As used in this specification the term "hydrocarbon . . . " and related terms refer to a group having a hydrocarbon or predominantly hydrocarbon character. Among these, there may be mentioned hydrocarbon groups, including aliphatic, (e.g., alkyl), alicyclic (e.g., cycloalkyl), aromatic, aliphatic and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. The groups may also or alternatively contain atoms other than carbon in a chain or ring otherwise composed of carbon atoms.

In a second aspect, the present invention provides an additive composition comprising (i) an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations, and (ii) a cold flow improver selected from (A) ethylene-unsaturated ester compounds, (B) comb polymers, (C) polar nitrogen compounds, (D) compounds comprising a ring system having at least two substituents comprising a linear or branched aliphatic hydrocarbylene group optionally interrupted by one or more hetero atoms and carrying a secondary amino group, the substituents on the amino groups each being a hydrocarbyl group containing 9 to 40 carbons, (E) hydrocarbon polymers, and (F) polyoxyalkylene compounds, the components A to F being other than a component as defined in (i).

In a third aspect, the present invention further provides a fuel oil composition comprising a major proportion of a fuel oil and a minor proportion of an additive composition comprising;

(i) an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations, and (ii) a cold flow improver other than one as defined in (i).

More especially, in the fuel oil composition aspect, component (ii) of the additive composition is a cold flow improver as defined under (A) to (F) above.

In a forth aspect, the present invention still further provides an additive concentrate comprising a fuel oil and a minor proportion of the additive composition comprising (i) an oil-soluble hydrogenated block diene polymer, comprising at least one crystallizable block, obtainable by end-to-end polymerization of a linear diene, and at least one non-crystallizable block, the non-crystallizable block being obtainable by 1,2-configuration polymerization of a linear diene, by polymerization of a branched diene, or by a mixture of such polymerizations, and (ii) a cold flow improver other than one as defined in (i).

The invention still further provides an additive concentrate comprising a solvent miscible with fuel oil and a minor proportion of an additive composition as defined in the second aspect of the invention.

In British Specification No. 1490563, there is disclosed the use of a hydrogenated homopolymer of butadiene or a copolymer of butadiene with a $C_5$ to $C_8$ diene as a cold flow improver for fuels. The copolymer is produced by polymerizing, e.g., a butadiene-isopropene mixture. GB-A-2087425 describes the use of a reaction product of a cyclic anhydride with an N-alkyl polyamine combined with, inter alia, a hydrogenated butadieneisoprene copolymer.

WO 92/16567, describes hydrogenated block copolymers of butadiene and, inter alia, isoprene, and oleaginous compositions containing them, the disclosure of which is incorporated herein by reference. Their use is predominantly as viscosity index improvers in lubricating oils, but there are also references to use in fuels.

WO 92/16568, describes hydrogenated block polymers containing 1,4-butadiene and 1,2-butadiene addition products, the disclosure of which is incorporated herein by reference. Their uses are said to be similar to those of the polymers of WO 92/16567.

In the present invention, hydrogenated block polymers are used, preferably in combination with other cold flow improvers, to improve low temperature performance of fuel oils.

Advantageously, the hydrogenated block copolymer used in the present invention comprises at least one substantially linear crystallizable segment or block and at least one segment or block that is essentially not crystallizable. Without wishing to be bound by any theory, it is believed that when butadiene is homopolymerized with a sufficient proportion of 1,4 (or end-to-end) enchainments to provide a substantially linear polymeric structure then on hydrogenation it resembles polyethylene and crystallizes rather readily; when a branched diene is polymerized on its own or with butadiene a branched structure will result (e.g., a hydrogenated polyisoprene structure will resemble an ethylene-propylene copolymer) that will not readily form crystalline domains but will confer fuel oil solubility on the block copolymer.

Advantageously, the block copolymer before hydrogenation comprises units derived from butadiene only, or from butadiene and at least one comonomer of the formula $$CH_2{=}CR^1{-}CR^2{=}CH_2$$

wherein $R^1$ represents a $C_1$ to $C_8$ alkyl group and $R^2$ represents hydrogen or a $C_1$ to $C_8$ alkyl group. Advantageously the total number of carbon atoms in the comonomer is 5 to 8, and the comonomer is advantageously isoprene. Advantageously, the copolymer contains at least 10% by weight of units derived from butadiene.

After hydrogenation, the copolymer advantageously contains at least 9%, for example 10%, preferably from 9 to 76%, more preferably 9 to 40%, for example 9 to 36%, by weight of at least one crystalline or crystallizable segment composed primarily of methylene units; to this end the crystallizable segment before hydrogenation advantageously has an average 1,4 or end-to-end enchainment of at least 70 mole, preferably at least 90 mole, percent. The hydrogenated block copolymer comprises at least one low crystallinity (or difficulty crystallizable) segment composed of methylene and substituted .methylene units, derived from one or more alkyl-substituted monomers described above, e.g., isoprene and 2-3dimethylbutadiene.

Alternatively, the low crystallinity segment may be derived from butadiene by 1,2 enchainment, in which the segment has before hydrogenation an average 1,4 enchainment of butadiene of at most 30, preferably at most 10, percent. As a result, the polymer comprises 1,4-polybutadiene as one block and 1,2-polybutadiene as another. Such polymers are obtainable by, e.g., adding a catalyst modifier, as described in the above-referred WO92/16568.

A further advantageous block copolymer is a star copolymer having from 3 to 25, preferably 5 to 15, arms.

Advantageous embodiments of block copolymers are those comprising a single crystallizable block and a single non-crystallizable block (a 'di-block' polymer) and those comprising a single non-crystallizable block having at each end a single crystallizable block (a 'tri-block' polymer). Other tri- and tetra-block copolymers are also available. In certain preferred embodiments, in which the copolymer is derived from butadiene and isoprene, these di- and tri-block polymers are referred to below as PE-PEP and PE-PEP-PE copolymers respectively.

In general, the crystallizable block or blocks will be the hydrogenation product of the unit resulting from predominantly 1,4- or end-to-end polymerization of butadiene, while the non-crystallizable block or blocks will be the hydrogenation product of the unit resulting from 1,2-polymerization of butadiene or from 1,4-polymerization of an alkyl-substituted butadiene, for example isoprene.

Advantageously the number average molecular weight, Mn, of the hydrogenated block copolymer, measured by GPC, lies in the range of 500 to 100,000, more advantageously 500 to 20,000, preferably 500 to 10,000 and more preferably from 2,000 to 5,000.

Advantageously, in a diblock polymer, the molecular weight of the crystallizable block is from 500 to 20,000, and preferably from 500 to 5,000, and that of the noncrystallizable block is from 500 to 50,000, preferably from 11000 to 5,000. In a triblock polymer, the molecular weight of each crystallizable block is advantageously from 500 to 20,000, advantageously about 5,000, and that of the non-crystallizable block is from 1,000 to 20,000, preferably 1,000 to 5,000.

The proportion of the total molecular weight of a block copolymer represented by a crystalline block or blocks may be determined by H or C NMR, and the total molecular weight of the polymer by GPC, optionally in combination with conventional light-scattering techniques.

As indicated in more detail in the above-identified PCT Application WO/16567 on pages 35 and 36, the precursor block copolymers are conveniently prepared by anionic polymerization, which facilitates control of structure and molecular weight, preferably using a metallic or organometallic catalyst. Thus, for example, a crystallizable block is first formed by end-to-end polymerisation of a linear diene, eg butadiene, followed by addition and polymerisation of further or different monomer to provide a non-crystallisable block. Sequential monomer addition and polymerisation can be continued to give further blocks. Hydrogenation is effected employing conventional procedures, using elevated temperature and hydrogen pressure in the presence of a hydrogenation catalyst, preferably palladium on barium sulphate or calcium carbonate or nickel octanoate/triethyl aluminium.

Advantageously, at least 90% of the original unsaturation (as measured by NMR spectroscopy) is removed on hydrogenation, preferably at least 95%, and more preferably at least 98%.

The fuel oil may be, e.g., a petroleum-based fuel oil, especially a middle distillate fuel oil. Such distillate fuel oils generally boil within the range of from 110° C. to 500° C., e.g. 150° C. to 400° C.

The invention is applicable to middle distillate fuel oils of all types, including the broad-boiling distillates, i.e., those having a 90%–20% boiling temperature difference, as measured in accordance with ASTM D-86, of 100° C. or more and an FBP—90% of 30° C. or more, and more especially to the more difficult to treat narrow boiling distillates, having a 90%–20% boiling range of less than 100° C., especially from 70° C. to 100° C., an FBP—90° C. of less than 30° C., and a final boiling point of 370° C. or below, generally in the 350° C. to 370° C. range.

The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or it may contain minor amounts, e.g. up to 35 wt %, of vacuum gas oil or cracked gas oil or of both. The abovementioned low temperature flow problem is most usually encountered with diesel fuels and with heating oils. The invention is also applicable to vegetable based fuel oils, for example rape seed oil, used alone or in admixture with a petroleum distillate oil.

The compositions of the invention are especially useful in fuel oils having a relatively high wax content, e.g., a wax content above 3% by weight at 10° C. below cloud point.

The compositions should preferably be soluble in the oil to the extent of at least 500 ppm by weight per weight of oil at ambient temperature. Less soluble compositions may cause filter blocking problems in the absence of wax. The "Navy Rig" test, discussed in more detail in Example 5 below, is used to establish whether a composition is likely to cause such problems: the present block copolymers show some advantage in the test.

In the preferred embodiments of the invention, component (ii) of the additive composition may be:

(A) An ethylene-unsaturated ester copolymer, more especially one having, in addition to units derived from ethylene, units of the formula $$—CR^3R^4—CHR^5—$$

wherein $R^3$ represents hydrogen or methyl, $R^4$ represents $COOR^6$, wherein $R^6$ represents an alkyl group having from 1 to 9 carbon atoms, which is straight chain or, if it contains 3 or more carbon atoms, branched, or $R^4$ represents $OOCR^7$, wherein $R^7$ represents $R^6$ or H, and $R^5$ represents H or $COOR^6$.

These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, or ethylene-vinyl octanoate copolymer is preferred.

As disclosed in U.S. Pat. No. 3,961,916, flow improver compositions may comprise a wax growth arrestor and a nucleating agent. Without wishing to be bound by any theory, the applicants believe that component (i) of the additive composition of the invention acts primarily as a nucleator and will benefit from the presence of an arrestor. This may, for example, be an ethylene-unsaturated ester as described above, especially an EVAC with a molecular weight (Mn, measured by gel permeation chromatography against a polystyrene standard) of at most 14000, advantageously at most 10000, preferably 2000 to 6000, and more preferably from 2000 to 5500, and an ester content of 7.5% to 35%, preferably from 10 to 20, and more preferably from 10 to 17, molar percent.

It is within the scope of the invention to include an additional nucleator, e.g., an ethylene-unsaturated ester, especially vinyl acetate, copolymer having a number average molecular weight in the range of 1200 to 20000, and a vinyl ester content of 0.3 to 10, advantageously 3.5 to 7.0 molar percent.

(B) A comb polymer.

Such polymers are polymers in which branches containing hydrocarbyl groups are pendant from a polymer backbone, and are discussed in "Comb-Like Polymers, Structure and Properties", N. A. Platé and V. P. Shibaev, J. Poly. Sci. Macromolecular Revs., 8, p 117 to 253 (1974).

Generally, comb polymers have one or more long chain hydrocarbyl branches, e.g., oxyhydrocarbyl branches, normally having from 10 to 30 carbon atoms, pendant from a polymer backbone, said branches being bonded directly or indirectly to the backbone. Examples of indirect bonding include bonding via interposed atoms or groups, which bonding can include covalent and/or electrovalent bonding such as in a salt.

Advantageously, the comb polymer is a homopolymer having, or a copolymer at least 25 and preferably at least 40, more preferably at least 50, molar percent of the units of which have, side chains containing at least 6, and preferably at least 10, atoms.

As examples of preferred comb polymers there may be mentioned those of the general formula

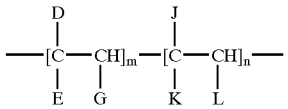

wherein D=$R^{11}$, $COOR^{11}$, $OCOR^{11}$, $R^{12}COOR^{11}$, or $OR^{11}$,

E=H, $CH_3$, D, or $R^{12}$,

G=H or D

J=H, $R^{12}$, $R^{12}COOR^{11}$, or an aryl or heterocyclic group,

K=H, $COOR^{12}$, $OCOR^{12}$, $OR^{12}$ or COOH,

L=H, $R^{12}$, $COOR^{12}$, $OCOR^{12}$, COOH, or aryl, $R^{11} \geqq C_{10}$ hydrocarbyl, $R^{12} \geqq C_1$ hydrocarbyl or hydrocarbylene, and m and n represent mole fractions, m being finite and preferably within the range of from 1.0 to 0.4, n being less than 1 and preferably in the range of from 0 to 0.6.

$R^{11}$ advantageously represents a hydrocarbyl group with from 10 to 30 carbon atoms, while $R^{12}$ advantageously represents a hydrocarbyl or hydrocarbylene group with from 1 to 30 carbon atoms.

The comb polymer may contain units derived from other monomers if desired or required.

These comb polymers may be copolymers of maleic anhydride or fumaric or itaconic acids and another ethylenically unsaturated monomer, e.g., an α-olefin, including styrene, or an unsaturated ester, for example, vinyl acetate or homopolymer of fumaric or itaconic acids. It is preferred but not essential that equimolar amounts of the comonomers be used although molar proportions in the range of 2 to 1 and 1 to 2 are suitable. Examples of olefins that may be copolymerized with e.g., maleic anhydride, include 1-decene, 1-dodecene, Itetradecene, 1-hexadecene, and 1-octadecene.

The acid or anhydride group of the comb polymer may be esterified by any suitable technique and although preferred it is not essential that the maleic anhydride or fumaric acid be at least 50% esterified. Examples of alcohols which may be used include n-decan-1-ol, ndodecan-1-ol, n-tetradecan-1-ol, n-hexadecan-1-ol, and noctadecan-1-ol. The alcohols may also include up to one methyl branch per chain, for example, 1-methylpentadecan1-ol or 2-methyltridecan-1-ol. The alcohol may be a mixture of normal and single methyl branched alcohols.

It is preferred to use pure alcohols rather than the commercially available alcohol mixtures but if mixtures are used the $R^{12}$ refers to the average number of carbon atoms in the alkyl group; if alcohols that contain a branch at the 1 or 2 positions are used $R^{12}$ refers to the straight chain backbone segment of the alcohol.

These comb polymers may especially be fumarate or itaconate polymers and copolymers such for example as those described in EP-A-153176, -153177 and -225688, and WO 91/16407.

Particularly preferred fumarate comb polymers are copolymers of alkyl fumarates and vinyl acetate, in which the alkyl groups have from 12 to 20 carbon atoms, more especially polymers in which the alkyl groups have 14 carbon atoms or in which the alkyl groups are a mixture of $C_{14}/C_{16}$ alkyl groups, made, for example, by solution copolymerizing an equimolar mixture of fumaric acid and vinyl acetate and reacting the resulting copolymer with the alcohol or mixture of alcohols, which are preferably straight chain alcohols. When the mixture is used it is advantageously a 1:1 by weight mixture of normal $C_{14}$ and $C_{16}$ alcohols. Furthermore, mixtures of the $C_{14}$ ester with the mixed $C_{14}/C_{16}$ ester may advantageously be used. In such mixtures, the ratio of $C_{14}$ to $C_{14}/C_{16}$ is advantageously in the range of from 1:1 to 4:1, preferably 2:1 to 7:2, and most preferably about 3:1, by weight. The particularly preferred comb polymers are those having a number average molecular weight, as measured by vapour phase osmometry, of 1,000 to 100,000, more especially 1,000 to 30,000.

Other suitable comb polymers are the polymers and copolymers of α-olefins and esterified copolymers of styrene and maleic anhydride, and esterified copolymers of styrene and fumaric acid; mixtures of two or more comb polymers may be used in accordance with the invention and, as indicated above, such use may be advantageous. Other examples of comb polymers are hydrocarbon polymers, e.g., copolymers of ethylene and at least one α-olefin, the α-olefin preferably having at most 20 carbon atoms, examples being n-decene-1 and n-dodecene-1. Preferably, the number average molecular weight of such a copolymer is at least 30,000 measured by GPC. The hydrocarbon copolymers may be prepared by methods known in the art, for example using a Ziegler type catalyst.

(C) Polar nitrogen compounds.

Such compounds are oil-soluble polar nitrogen compounds carrying one or more, preferably two or more, substituents of the formula $>NR^{13}$, where $R^{13}$ represents a hydrocarbyl group containing 8 to 40 atoms, which substituent or one or more of which substituents may be in the form of a cation derived therefrom. The oil soluble polar nitrogen compound is generally one capable of acting as a wax crystal growth inhibitor in fuels, it comprises for example one or more of the following compounds.

An amine salt and/or amide formed by reacting at least one molar proportion of a hydrocarbyl-substituted amine with a molar proportion of a hydrocarbyl acid having from 1 to 4 carboxylic acid groups or its anhydride, the substituent(s) of formula $>NR^{13}$ being of the formula $—NR^{13}R^{14}$ where $R^{13}$ is defined as above and $R^{14}$ represents hydrogen or $R^{13}$, provided that $R^{13}$, and $R^{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include dioctacedyl amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic acid, and carboxylic acids based on cyclic skeletons, e.g., cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids e.g., phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates, for example, those described in EP-A-327427.

(D) A compound containing a cyclic ring system carrying at least two substituents of the general formula below on the ring system $$—A—NR^{15}R^{16}$$

where A is a linear or branched chain aliphatic hydrocarbylene group optionally interrupted by one or more hetero atoms, and $R^{15}$ and $R^{16}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or polymethylene group. Such compounds are described in WO 93/04148.

(E) A hydrocarbon polymer.

Examples of suitable hydrocarbon polymers are those of the general formula

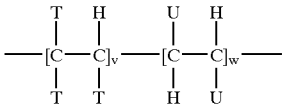

wherein T=H or $R^{21}$ wherein $R^{21}$=$C_1$ to $C_{40}$ hydrocarbyl, and

U=H, T, or aryl and v and w represent mole fractions, v being within the range of from 1.0 to 0.0, w being in the range of from 0.0 to 1.0.

Examples of hydrocarbon polymers are disclosed in WO 91/11488.

Preferred copolymers are ethylene α-olefin copolymers, having a number average molecular weight of at least 30,000. Preferably the α-olefin has at most 28 carbon atoms. Examples of such olefins are propylene, 1-butene, isobutene, n-octene-1, isooctene-1, n-decene-1, and n-dodecene-1. The copolymer may also comprise small amounts, e.g., up to 10% by weight, of other copolymerizable monomers, for example olefins other than α-olefins, and non-conjugated dienes. The preferred copolymer is an ethylene-propylene copolymer.

The number average molecular weight of the ethylene α-olefin copolymer is, as indicated above, preferably at least 30,000, as measured by gel permeation chromatography (GPC) relative to polystyrene standards, advantageously at least 60,000 and preferably at least 80,000. Functionally no upper limit arises but difficulties of mixing result from increased viscosity at molecular weights above about 150,000, and preferred molecular weight ranges are from 60,000 and 80,000 to 120,000.

Advantageously, the copolymer has a molar ethylene content between 50 and 85 percent. More advantageously, the ethylene content is within the range of from 57 to 80%, and preferably it is in the range from 58 to 73%; more preferably from 62 to 71%, and most preferably 65 to 70%.

Preferred ethylene-α-olefin copolymers are ethylene-propylene copolymers with a molar ethylene content of from 62 to 71% and a number average molecular weight in the range 60,000 to 120,000; especially preferred copolymers are ethylene-propylene copolymers with an ethylene content of from 62 to 71% and a molecular weight from 80,000 to 100,000.

The copolymers may be prepared by any of the methods known in the art, for example using a Ziegler type catalyst. The polymers should be substantially amorphous, since highly crystalline polymers are relatively insoluble in fuel oil at low temperatures.

Other suitable hydrocarbon polymers include a low molecular weight ethylene-α-olefin copolymer, advantageously with a number average molecular weight of at most 7500, advantageously from 1,000 to 6,000, and preferably from 2,000 to 5,000, as measured by vapour phase osmometry. Appropriate α-olefins are as given above, or styrene, with propylene again being preferred. Advantageously the ethylene content is from 60 to 77 molar percent, although for ethylene-propylene copolymers up to 86 molar percent by weight ethylene may be employed with advantage.

(F) A polyoxyalkylene compound.

Examples are polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkyl group in said polyoxyalkylene glycol containing from 1 to 4 carbon atoms. These materials form the subject of EP-A-0 061 895. Other such additives are described in U.S. Pat. No. 4,491,455.

The preferred esters, ethers or ester/ethers are those of the general formula $$R^{31}—O(D)—O—R^{32}$$

where $R^{31}$ and $R^{32}$ may be the same or different and represent (a) n-alkyl- (b) n-alkyl-CO—

(c) n-alkyl-O—$CO(CH_2)_x$— or (d) n-alkyl-O—$CO(CH_2)_x$—CO— x being, for example, 1 to 30, the alkyl group being linear and containing from 10 to 30 carbon atoms, and D representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. D may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10–30 carbon atoms are useful for reacting with the glycols to form the ester additives, it being preferred to use a $C_{18}$–$C_{24}$ fatty acid, especially behenic acid. The esters may also be prepared by esterifying polyethoxylated fatty acids or polyethoxylated alcohols.

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication Nos. 2-51477 and 3-34790, and the esterified alkoxylated amines described in EP-A-117,108 and EP-A-326,356.

It is within the scope of the invention to use two or more components (i) and/or two or more components (ii) advantageously selected from one or more of the different classes A to F outlined above.

The additive composition of the invention is advantageously employed in a proportion within the range of from 0.001% to 1%, advantageously 0.005% to 0.5%, and preferably from 0.01 to 0.075%, by weight, based on the weight of fuel oil.

Components (i) and (ii) are advantageously employed in a proportion of 1:99 to 99:1, more advantageously from 2:98 to 50:50, and preferably from 5:95 to 25:75.

The additive composition of the invention may also be used in combination with one or more other coadditives such as known in the art, for example the following: detergents, particulate emission reducers, storage stabilizers, antioxidants, corrosion inhibitors, dehazers, demulsifiers, antifoaming agents, cetane improvers, cosolvents, package compatibilizers, and lubricity additives.

Additive concentrates according to the invention advantageously contain between 3 and 75%, preferably between 10 and 65%, of the active ingredients of the composition in a fuel oil or a solvent miscible with fuel oil.

The following Examples, in which all parts and percentages are by weight, illustrate the invention.

The test designated CFPP was carried out in accordance with the procedure described in "Journal of the Institute of Petroleum", 52 (1966), 173.

The fuels used were as shown in Table 1 below.

TABLE 1

| Distillation Data ASTM D86, ° C. | Fuel A | Fuel B | Fuel C | Fuel D | Fuel E |
|---|---|---|---|---|---|
| IBP | 183 | 207 | 175 | 196 | 154 |
| 20% | 258 | 245 | 247 | 244 | 210 |
| 50% | 303 | 281 | 290 | 281 | 251 |
| 90% | 356 | 343 | 337 | 328 | 323 |
| FBP | 381 | 374 | 359 | 354 | 361 |
| 90%–20% | 98 | 95 | 90 | 84 | 113 |
| Cloud Point, ° C. | +6 | +2 | +1 | −3 | −8 |
| CFPP, ° C. | −1 | −1 | −6 | −6 | |
| Wax Content %, at 10° C. below W.A.T. | 3.1 | 2.4 | 3.73 | 4.04 | 1.9 |

As component (i) of the additive composition, a number of different hydrogenated block copolymers were used. There are identified in Table 2 below in terms of their polyethylene (PE) and poly(ethylene-propylene) PEP block contents, measured in Daltons, and their mass % of PE block of the total polymer.

TABLE 2

| Component (i) | PE/PEP Block | Mass % PE |
|---|---|---|
| 1 | 2K/3.5K PE-PEP | 36 |
| 2 | 5K/5K PE-PEP | 50 |
| 3 | 4.9/10K PE-PEP | 33 |
| 4 | 3.4K/1.1K PE-PEP | 76 |
| 5 | 2.5K/5.0K PE-PEP | 33 |
| 6 | 5K/15K PE-PEP | 25 |
| 7 | 10K/70K PE-PEP | 12 |
| 8 | 12K/12K/12K PE-PEP-PE | 66 |
| 9 | 9K/90K PE-PEP | 9 |
| 10 | 2K/6.2K PE-PEP | 24 |
| (Comparative) | 10K/12K PEP-PS (polystyrene) | 0 |

For example, polymer 1 is a diblock copolymer of molecular weight 5,500, made up of a polyethylene block of m.w. 2,000 and a poly(ethylene-propylene) block of m.w. 3,500, and being obtained by anionic polymerisation of butadiene and subsequent polymerisation with isoprene, followed by hydrogenation of the resulting diblock polymer. The other exemplified polymers were obtained analogously.

The hydrogenated block copolymers were used in conjunction with an ethylene-vinyl acetate copolymer, 36.5% by weight vinyl acetate, Mn 3,300 and linearity of 3 to 4 $CH_3/100CH_2$ (Additive A) or the adduct of phthalic anhydride and di-hydrogenated tallow amine (Additive B), both materials being regarded as arresters.

Additive C, used for comparison purposes, is a commercial ethylene-vinyl acetate copolymer with an ester content of 13.5%, Mn 5000. The Mn's of Additives A & C were measured by GPC against a polystyrene standard.

Additive D is Additive A transesterified with methyl octanoate until less than 2% of the acetate groups remain. Additive D is regarded as being essentially an ethylene-vinyl octanoate copolymer.

EXAMPLE 1

In this example, the effects of additive compositions of the invention on the CFPP of Fuel A were evaluated. The compositions comprises block copolymers 2, 7 and 8, identified in Table 2 above, in combination with flow improver A or both A and B. The results are shown in Table 3 below, the numbers below each component being the proportion of active material in ppm based on the weight of fuel:

TABLE 3

| Component | | | | | |
|---|---|---|---|---|---|
| A | B | 2 | 7 | 8 | CFPP ° C. |
| — | — | — | — | — | −1 |
| 225 | — | — | — | — | −1 |
| 270 | — | — | — | — | −8 |
| 300 | — | — | — | — | −4 |
| 225 | — | 75 | — | — | −12 |
| 225 | — | — | 75 | — | −12 |
| 225 | — | — | — | 75 | −13 |
| 270 | — | 30 | — | — | −16 |
| 270 | — | — | 30 | — | −13 |
| 270 | — | — | — | 30 | −16 |
| 180 | 120 | — | — | — | −3 |
| 135 | 120 | 45 | — | — | −14 |
| 135 | 120 | — | 45 | — | −13 |
| 135 | 120 | — | — | 45 | −13 |

The results show that the additive compositions of the invention are effective in lowering the CFPP of this fuel.

EXAMPLE 2

In this example, the effects of additive compositions of the invention on the CFPP of Fuel B were evaluated. The compositions comprise block copolymers 2, 7 and 8, identified in Table 2 above, in combination with flow improver A or both A and B. The results are shown in Table 4 below, the numbers below each component being the proportion of active material in ppm based on the weight of fuel:

TABLE 4

| Component | | | | | |
|---|---|---|---|---|---|
| A | B | 2 | 7 | 8 | CFPP ° C. |
| — | — | — | — | — | −1 |
| 75 | — | — | — | — | −3 |
| 90 | — | — | — | — | −3 |
| 100 | — | — | — | — | −3 |
| 75 | — | 25 | — | — | −13 |
| 75 | — | — | 25 | — | −13 |
| 75 | — | — | — | 25 | 15 |
| 90 | — | 10 | — | — | −14 |
| 90 | — | — | 10 | — | −14 |
| 90 | — | — | — | 10 | −16 |
| 60 | 40 | — | — | — | −1 |
| 45 | 40 | 15 | — | — | −13 |
| 45 | 40 | — | 15 | — | −12 |
| 45 | 40 | — | — | 15 | −12 |

The results show that the additive compositions of the invention are effective in lowering the CFPP of this fuel.

EXAMPLE 3

In this example, the effects of additive compositions of the invention on the CFPP of Fuel C were evaluated. The compositions comprise block copolymers 2, 6, 7 and 8, identified in Table 4 above, in combination with flow improver A or B. The results are shown in Table 5 below, the numbers below each component being the proportion of active material in ppm based on the weight of fuel:

TABLE 5

| Component | | | | | | |
|---|---|---|---|---|---|---|
| A | B | 2 | 6 | 7 | 8 | CFPP ° C. |
| — | — | — | — | — | — | −6 |
| 300 | — | — | — | — | — | −8, −9 |
| 350 | — | — | — | — | — | −8, −10 |
| 315 | — | 35 | — | — | — | −12 |
| 315 | — | — | 35 | — | — | −14 |
| 315 | — | — | — | 35 | — | −16 |
| 315 | — | — | — | — | 35 | −11 |
| — | 300 | — | — | — | — | −14 |
| — | 350 | — | — | — | — | −15 |
| — | 315 | 35 | — | — | — | −16 |
| — | 315 | — | 35 | — | — | −17 |
| — | 315 | — | — | 35 | — | −20 |
| — | 315 | — | — | — | 35 | −17 |

The results show the effectiveness in this relatively narrow boiling fuel of the additive compositions of the invention.

EXAMPLE 4

In this example, the effects of additive compositions of the invention on the CFPP of a narrow boiling fuel, Fuel D, were evaluated. The block copolymers identified by number with reference to Table 2 above were used in combination with additive D at a 1:9 ratio, at two different total treat rates, 400 and 500 ppm based on the weight of fuel. The results are shown in Table 6 below:

TABLE 6

| Block Copolymer in combination | CFPP, ° C. at Given Treat Rate 1:9 ratio of Block Copolymer:D | |
|---|---|---|
| with Additive D | 400 ppm | 500 ppm |
| No Additive | −6 | −6 |
| Additive D Alone | −15 | −17 |
| 1 | −13 | −20 |
| 2 | −17 | −11 |
| 3 | −17 | −18 |
| 4 | −18 | −18 |
| 5 | −19 | −21 |
| 6 | −18 | −19 |
| 7 | −16 | −17 |
| 8 | −11 | −20 |
| 9 | −17 | −19 |
| 10 | −18 | −19 |
| Comparison | −10 | −17 |

While block copolymers in compositions according to the invention show an ability to enhance CFPP depression of Additive D, the known PEP-PS does not.

EXAMPLE 5

In this example, the effects of further additive compositions on CFPP were evaluated. The block copolymers identified by number with reference to Table 2 above were used alone or in combination with additive A or additive B above, the treat rates shown in Table 7. The results are also shown in Table 7.

The fuel used had the following characteristics.

| | | | |
|---|---|---|---|
| Density 0.8568 | D-86 Distillation: | IBP | 221 |
| Cloud point 2° C. | (° C.) | 10% | 253 |
| | | 20% | 262 |
| | | 30% | 271 |
| | | 40% | 278 |
| | | 50% | 285 |
| | | 60% | 293 |
| | | 70% | 302 |
| | | 80% | 315 |
| | | 90% | 335 |
| | | FBP | 372 |

TABLE 7

| Component | | | | CFPP |
|---|---|---|---|---|
| 2 | 6 | A | B | (° C.) |
| — | — | — | — | 0 |
| 200 | — | — | — | −7 |
| 200 | — | 200 | — | −15 |
| 200 | — | — | 300 | −15 |
| — | 200 | — | — | −8 |
| — | 200 | 200 | — | −15 |
| — | 200 | — | 300 | −15 |

The results indicate that the hydrogenated block polymers alone provided beneficial CFPP performance, and further surprisingly-enhanced performance in combination with other cold flow improvers.

EXAMPLE 6

This example investigates the performance of fuels containing additive compositions according to the invention in the Institute of Petroleum Standard IP 387/90, "Determination of Filter Blocking Tendency of Gas Oils & Distillate Diesel Fuels", known informally as the "Navy Rig" test. Although reference is made to the Standard for full information, the test may be summarized as follows. A sample of fuel to be tested is passed at constant flow rate through a glass fibre filter; the pressure drop across the filter is monitored, and the change in pressure drop across the filter for a given volume of fuel passing the filter is measured. The filter blocking tendency of a fuel may be defined in terms of, for example, the pressure drop across the filter for 300 ml of fuel to pass at a rate of 20 ml/min.

In this example, carried out at 0° C. using the low wax fuel E, cloud point −8° C., fuels containing the compositions according to the invention and a composition in which both arrestor and nucleator were ethylene-vinyl acetate copolymers were tested and compared.

Each additive composition comprised, per hundred parts by weight, 40 parts solvent, 48.6 parts arrestor (Additive A) and 11.4 parts nucleator, the composition being used at a treat rate of 500 ppm, i.e. 300 ppm active ingredients. The nucleators are identified in Table 8 below.

TABLE 8

| Arrestor | Nucleator | Results, psi/kP |
|---|---|---|
| A | 3 | 4.6/32 |
| A | 5 | 7.3/50 |
| A | C | Fail, 10 mins |

The results show that replacement of the ethylene vinyl acetate copolymer nucleator Additive C with the hydrogenated block copolymer leads to an improvement in filterability of the fuel.

What is claimed is:

1. A method of improving the cold flow characteristics of a fuel oil, the method comprising adding to the fuel oil as a wax crystal modifier an additive composition comprising:

(i) an oil soluble hydrogenated block butadiene polymer, the polymer comprising at least one crystallizable block, obtainable by end-to-end polymerization of a linear butadiene and at least one non-crystallizable block, the non-crystallizable block being obtainable by 1,2-configuration polymerization of a linear butadiene, and (ii) a fuel oil cold flow improver other than the hydrogenated block butadiene polymer as defined in (i), and said cold flow improver is a fuel oil cold flow improver selected from:

(A) ethylene-unsaturated ester compounds, (B) comb polymers, (C) polar nitrogen compounds, (D) compounds comprising a ring system having at least two substituents comprising a linear or branched aliphatic hydrocarbylene group optionally interrupted by one or more hetero atoms and carrying a secondary amino group, the substituents on the amino groups each being a hydrocarbyl group containing 9 to 40 carbons, (E) polyoxyalkylene compounds, and (F) hydrocarbon polymers.

2. The method as claimed in claim 1, wherein the number average molecular weight, Mn, measured by GPC, of the hydrogenated block butadiene polymer is within the range of 500 to 10,000.

3. The method as claimed in claim 1, wherein the fuel oil is a middle distillate fuel oil.

4. A fuel oil composition comprising a major proportion of a fuel oil and a minor proportion of an additive composition comprising:

(i) an oil soluble hydrogenated block butadiene polymer, the polymer comprising at least one crystallizable block, obtainable by end-to-end polymerization of a linear butadiene, and at least one non-crystallizable block, the non-crystallizable block being obtainable by 1,2-configuration polymerization of a linear butadiene, and (ii) a fuel oil cold flow improver other than the hydrogenated block butadiene polymer as defined in (i), and said cold flow improver is a fuel oil cold flow improver selected from:

(A) ethylene-unsaturated ester compounds, (B) comb polymers, (C) polar nitrogen compounds, (D) compounds comprising a ring system having at least two substituents comprising a linear or branched aliphatic hydrocarbylene group optionally interrupted by one or more hetero atoms and carrying a secondary amino group, the substituents on the amino groups each being a hydrocarbyl group containing 9 to 40 carbons, (E) polyoxyalkylene compounds, and (F) hydrocarbon polymers.

5. A fuel oil composition as claimed in claim 4, wherein the number average molecular weight, Mn, measured by GPC, of the hydrogenated block butadiene polymer is within the range of 500 to 10,000.

6. A fuel oil composition as claimed in claim 4, wherein the fuel oil is a middle distillate fuel oil.

7. An additive composition for use as a wax crystal modifier to improve cold flow characteristics of a fuel oil, the additive composition comprising:

(i) an oil soluble hydrogenated block butadiene polymer, comprising at least one crystallizable block, obtainable by end-to-end polymerization of a linear butadiene, and at least one non-crystallizable block, the non-crystallizable block being obtainable by 1,2-configuration polymerization of a linear butadiene, and (ii) a fuel oil cold flow improver selected from (A) ethylene-unsaturated ester compounds, (B) comb polymers, (C) polar nitrogen compounds, (D) compounds comprising a ring system having at least two substituents comprising a linear or branched aliphatic hydrocarbylene group optionally interrupted by one or more hetero atoms and carrying a secondary amino group, the substituents on the amino groups each being a hydrocarbyl group containing 9 to 40 carbons, (E) polyoxyalkylene compounds, and (F) hydrocarbon polymers the components (A) to (F) being other than a hydrogenated block butadiene polymer as defined in (i).

8. The additive composition as claimed in claim 7, wherein the number average molecular weight, Mn, measured by GPC, of the hydrogenated block butadiene polymer is within the range of 500 to 10,000.

9. An additive concentrate comprising a fuel oil and an additive composition as defined in claim 7.

10. An additive concentrate comprising a fuel oil and an additive composition as defined in claim 8.

11. An additive concentrate comprising a solvent miscible with a fuel oil and the additive composition claimed in claim 7.

12. An additive concentrate comprising a solvent miscible with a fuel oil and the additive composition claimed in claim 8.

13. The method of claim 1 wherein the fuel oil is a narrow boiling distillate fuel oil.

14. The composition of claim 4 wherein the fuel oil is a narrow boiling distillate fuel oil.

* * * * *